US008235424B2

(12) United States Patent
Garcia

(10) Patent No.: US 8,235,424 B2
(45) Date of Patent: Aug. 7, 2012

(54) SKI POLE AND MAP APPARATUS

(76) Inventor: Evan Garcia, Dallas, TX (US)

( * ) Notice: Subject to any disclaimer, the term of this patent is extended or adjusted under 35 U.S.C. 154(b) by 314 days.

(21) Appl. No.: 12/552,935

(22) Filed: Sep. 2, 2009

(65) Prior Publication Data

US 2011/0049857 A1 Mar. 3, 2011

(51) Int. Cl.
*A63C 11/22* (2006.01)

(52) U.S. Cl. ..... 280/819; 280/816

(58) Field of Classification Search ..... 280/816, 280/819; 40/514, 517
See application file for complete search history.

(56) References Cited

U.S. PATENT DOCUMENTS 991,608 A * 5/1911 Day ..... 40/660
1,583,998 A * 5/1926 Richey ..... 40/517
2,251,579 A * 8/1941 Rugg ..... 242/379
2,610,420 A * 9/1952 Kohl ..... 40/317
3,443,820 A 5/1969 Baker
4,991,875 A * 2/1991 McDermott ..... 280/816
5,359,797 A * 11/1994 Williamson ..... 280/816
5,390,957 A * 2/1995 Metzler ..... 280/819
5,549,329 A 8/1996 Wuerslin et al.
6,301,812 B1 * 10/2001 Klunk ..... 40/124.06
6,779,537 B1 * 8/2004 Miller ..... 135/117

* cited by examiner

*Primary Examiner* — J. Allen Shriver, II
*Assistant Examiner* — Emma K Frick
(74) *Attorney, Agent, or Firm* — Baker Botts L.L.P.

(57) ABSTRACT

According to one embodiment, a ski pole comprises a first pole end, a second pole end opposite the first pole end, and a shaft connecting the first and second pole ends. A map comprises a first map end and a second map end opposite the first map end. A container is coupled to the shaft of the ski pole. The first map end of the map is coupled to an inside portion of the container. The container is configured to contain the map.

3 Claims, 10 Drawing Sheets

SKI POLE AND MAP APPARATUS

TECHNICAL FIELD

This invention generally relates to ski poles, and more particularly, to a ski pole and map apparatus.

BACKGROUND

Ski maps help skiers find various locations while skiing. These maps provide relevant information, including ski runs, chair lifts, terrain parks, restaurants, warming huts, ski patrol huts, restrooms, and the like. Maps typically come in one of two forms: small, pocket-sized folded maps or enlarged signs erected at various locations.

SUMMARY

According to one embodiment, a ski pole comprises a first pole end, a second pole end opposite the first pole end, and a shaft connecting the first and second pole ends. A map comprises a first map end and a second map end opposite the first map end. A container is coupled to the shaft of the ski pole. The first map end of the map is coupled to an inside portion of the container. The container is configured to contain the map.

Certain embodiments of the invention may provide numerous technical advantages. For example, a technical advantage of one embodiment may include allowing skiers to view ski trail maps at any location on the mountain without having to remove their gloves. Other technical advantages of other embodiments may include preventing a skier from destroying or losing the map while skiing. Yet another technical advantage of other embodiments may include providing accurate geographic information to a skier.

Although specific advantages have been enumerated above, it will be understood that various embodiments may include all, some, or none of the disclosed advantages. Additionally, other technical advantages not specifically cited may become apparent to one of ordinary skill in the art following review of the ensuing drawings and their associated detailed description.

BRIEF DESCRIPTION OF THE DRAWINGS

For a more complete understanding of example embodiments of the present invention and its advantages, reference is now made to the following description, taken in conjunction with the accompanying drawings, in which.

DETAILED DESCRIPTION

Figure 1A:
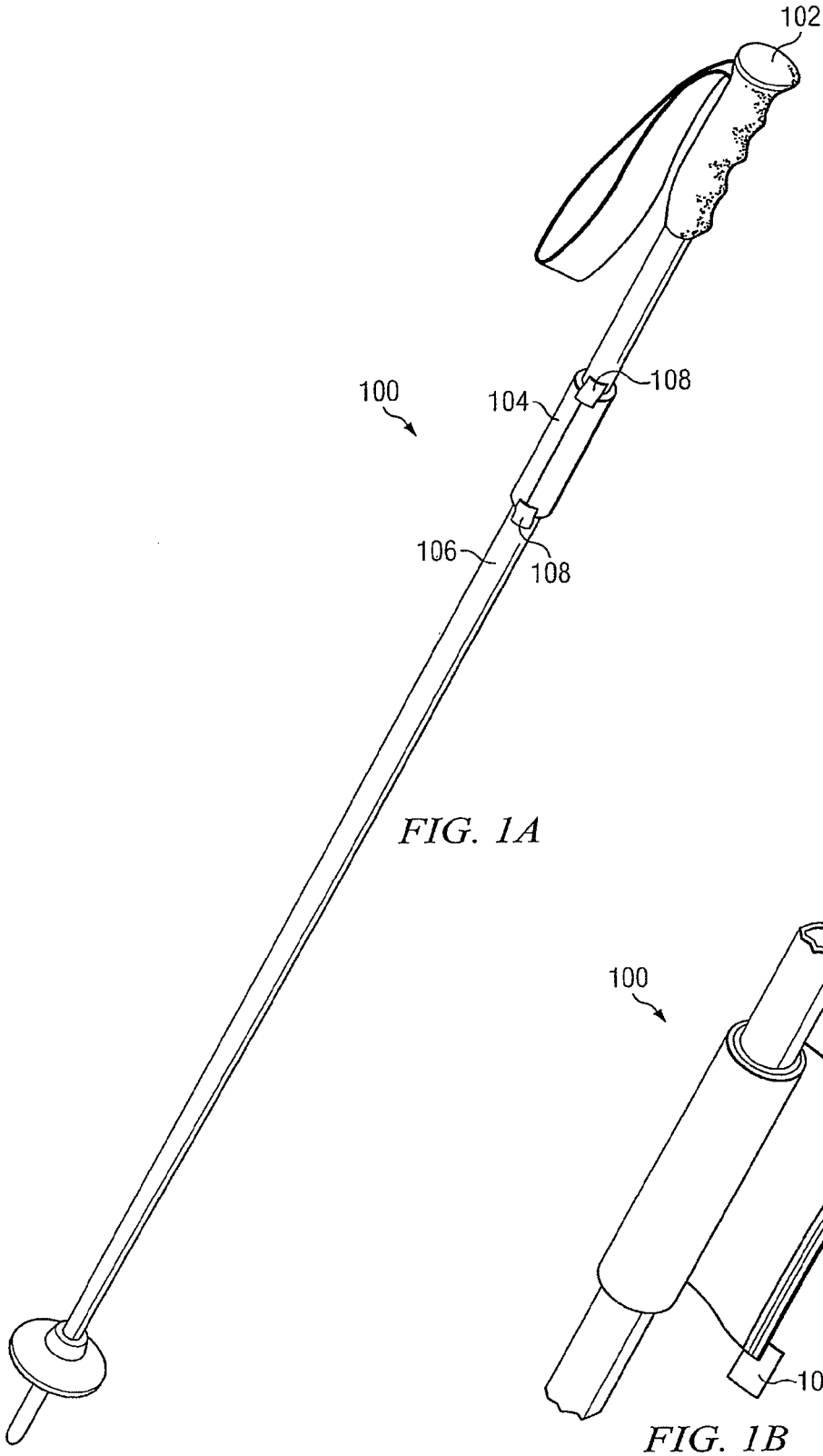
FIGS. 1A, 1B, 1C, 1D, 1E, 1F, and 1G show a ski pole/map assembly 100 according to several embodiments.

It should be understood at the outset that, although example implementations of embodiments of the invention are illustrated below, the present invention may be implemented using any number of techniques, whether currently known or not. The present invention should in no way be limited to the example implementations, drawings, and techniques illustrated below. Additionally, the drawings are not necessarily drawn to scale.

Ski facilities normally provide maps in two forms. In one form, maps are enlarged and erected as signs at various locations around the ski area. However, these signs are only beneficial to a skier if the skier can find a sign, determine a desired ski trail to take, and then ski to a second sign downhill for further directions. Additionally, ski facilities also offer pocket-sized maps that are prefolded so that they may be condensed and transported in the skier's pocket. However, to view these pocket maps, skiers must remove the map from their pocket, possibly while on the chair lift. In addition, because of the small size of these pocket-sized maps, skiers frequently must remove their gloves, exposing their hands to the elements. Thus, skiers risk losing or dropping their gloves, ski poles, or both.

Accordingly, teachings of certain embodiments recognize the capability to incorporate a map into a ski pole. Teachings of certain embodiments recognize the capability for skiers to view ski facility trail maps without having to remove their gloves. Teachings of certain embodiments also recognize the capability to prevent a skier from destroying or losing the map while skiing.

FIGS. 1A-1G show a ski pole/map assembly 100 according to several embodiments. One or more embodiments of the ski pole-map assembly 100 may include a grip 102, a map 104, a shaft 106, a tab 108, a map container 110, one or more map connector tabs 112, one or more fastening attachments 114, and/or sleeve 116.

Figure 1B:
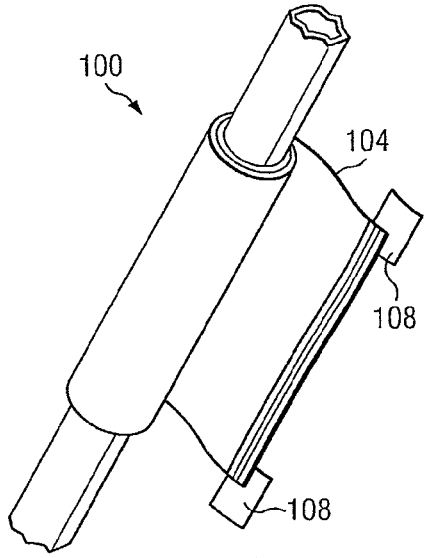
Figure 1C:
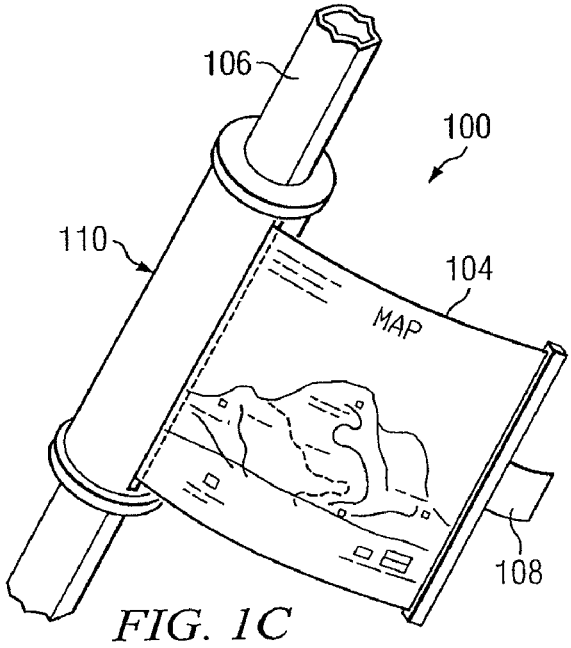
Figure 1D:
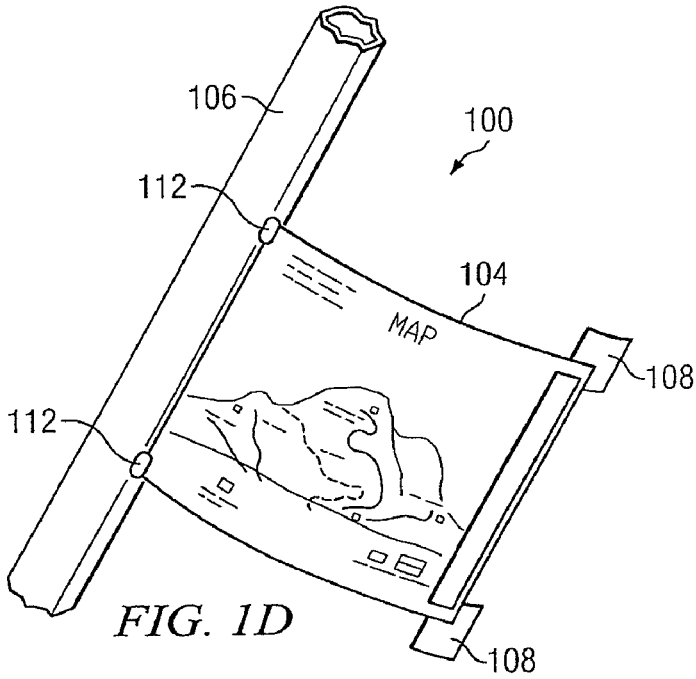
Figure 1E:
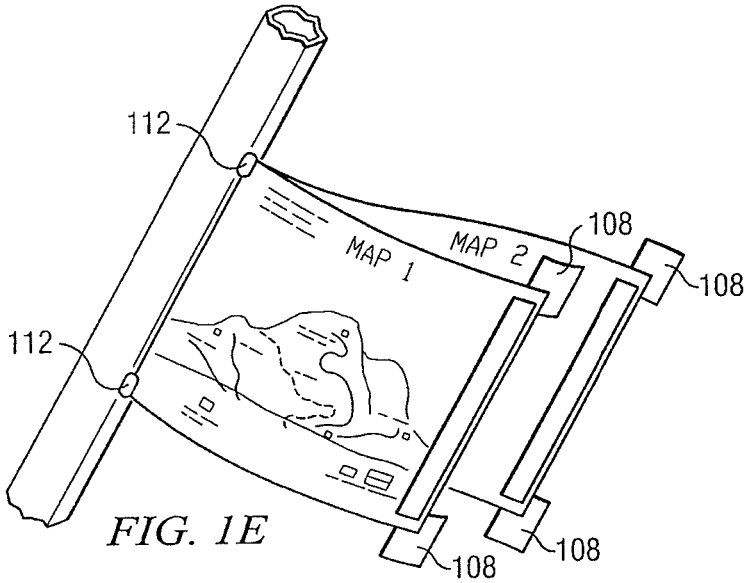
Figure 1F:
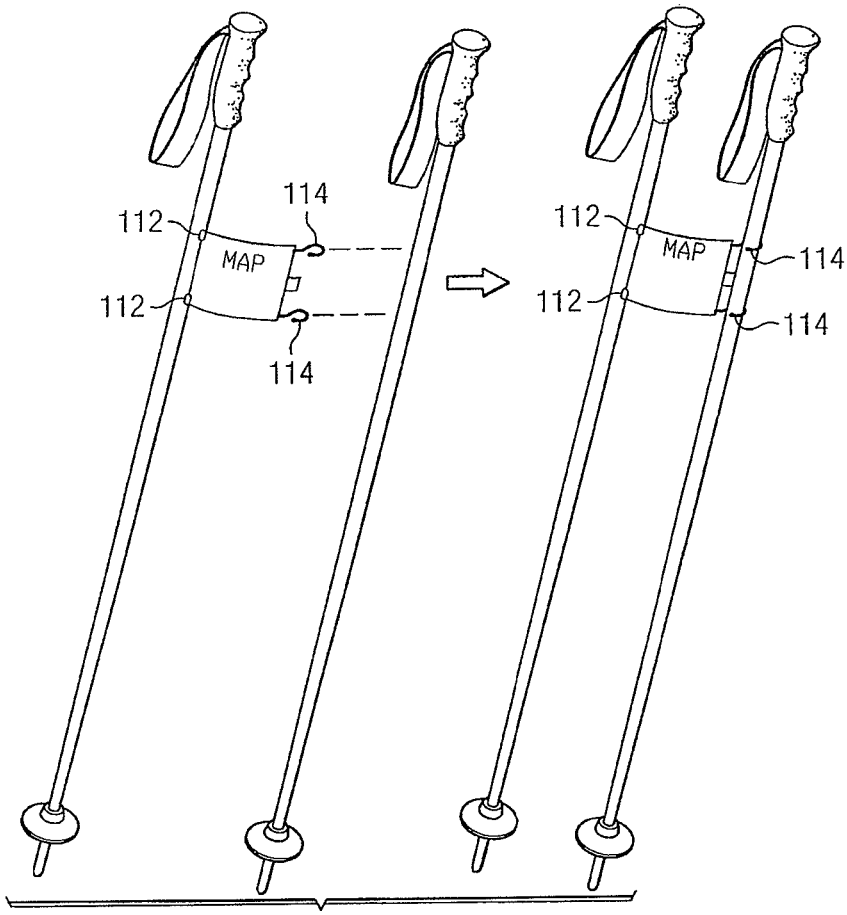
Figure 1G:
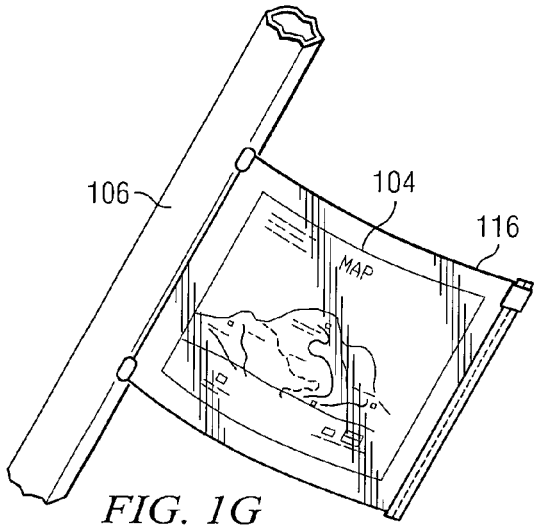

FIGS. 1A and 1B show map 104 rolled around shaft 106 below grip 102. FIG. 1C shows map 104 retracted from map container 110, which is attached to shaft 106. FIG. 1D shows map 104 attached directly to shaft 106. FIG. 1E shows two maps 104 attached directly to shaft 106. FIG. 1F shows an embodiment in which map 104 may hook to a second ski pole. FIG. 1G shows map 104 within weatherproof sleeve 116.

Grip 102 and shaft 106 may represent any suitable components that may be combined to form a ski pole. For example, grip 102 may include any suitable apparatus that a user may use to hold the ski pole. Grip 102 may be manufactured from any suitable material; for example, in some embodiments, grip 102 may include a plastic handle, a rubber grasp, or any other suitable component. In some embodiments, grip 102 may include indentations for a user to hold. Shaft 106 may be made of any suitable material. For example, in one embodiment, the shaft 106 may be made of a light-weight polymer or laminate.

Map 104 may represent any suitable representation of the skiing area. For example, in some embodiments, map 104 may pictorially represent a network of ski trails on a mountain. Map 104 may attach to shaft 106 using any suitable mechanism. For example, in some embodiments, map 104 may be rolled around shaft 106, recessed inside of shaft 106, or connected to shaft 106 by connector tabs 112. Map 104 may be made from or covered by any suitable material. For example map 104 may be made from a waterproof paper, vinyl, laminated paper, or any other suitable material.

Tab 108 may represent any suitable component configured to attach to map 104 to allow a user to access map 104. In some embodiments, tab 108 may be operable to close map 104. For example, tab 108 may close map 104 by wrapping around shaft 106 and securing the free end of map 104 to the ski pole using any suitable connection material, such as Velcro®.

Map container 110 may include any device operable to house map 104. For example, map container 110 may include a canister, a shell, or any other component suitable for housing map 104. Map container 110 couples to shaft 106 and may contain map 104. In some embodiments, map 104 may freely roll up inside of map container 110. In other embodiments, map 104 may be coupled to a spring winding mechanism inside of map container 110. An example of the spring winding mechanism may include the spring winding mechanism 312 of FIGS. 3A and 3*b*.

Connector tabs 112 may include any suitable device operable to attach map 104 to shaft 106. For example, in some embodiments, connector tabs 112 may be operable to releasably attach map 104 to shaft 106. In some embodiments, map 104 may be connected to shaft 106 using adhesive glue, Velcro®, or any other suitable connection material.

In some embodiments, sleeve 116 may encompass map 104. Sleeve 116 may represent any suitable cover that protects map 104 from outside elements, such as dirt, rain, ice, or snow. For example, sleeve 116 may be made from any suitable transparent or translucent weatherproof material, such as plastic or vinyl. In one embodiment, sleeve 116 may hold map 104 and attach to a spring winding mechanism inside of map container 110. An example of the spring winding mechanism may include the spring winding mechanism 312 of FIGS. 3A and 3*b*.

Fastening attachments 114 may include any suitable devices operable to attach the non-coupled end of map 104 to a second ski pole. For example, in some embodiments, fastening attachments 114 may include hooks, clips, or any other suitable component.

In operation, when a skier accesses map 104 without while wearing gloves, the skier can pull tab 108, which may be affixed to one side of map 104. When the skier pulls tab 108, map 104 may unroll and extend from shaft 106. Some embodiments may also allow the skier to attach the non-coupled end of map 104 to a second ski pole via one or more fastening attachments 114, enabling the skier to hold map 104 flat for viewing.

Modifications, additions, or omissions may be made to ski pole/map assembly 100. For example, some embodiments recognize that attaching map 104 to shaft 106 may place additional weight on shaft 106 or require a wider diameter shaft 106 in order to house map 104 inside shaft 106. In addition, shaft 106 may be bent or broken in an accident, which could potentially destroy map 104. Accordingly, teachings of certain embodiments recognize the use of a map recessed into the grip, as shown more fully in FIGS. 2A-2C.

As another example of modifications, additions, or omissions made to ski pole/map assembly 100, teachings of certain embodiments recognize that skiers often travel between multiple ski facilities, sometimes on the same day, and each facility has their own map. Accordingly, teachings of certain embodiments recognize the ability for a map system to incorporate multiple maps, as shown in FIGS. 4, 5A-5C, and 6A-6A. Additionally, teachings of certain embodiments also recognize the ability to incorporate an electronic map system, as shown in FIGS. 7A-7F.

Figure 2A:
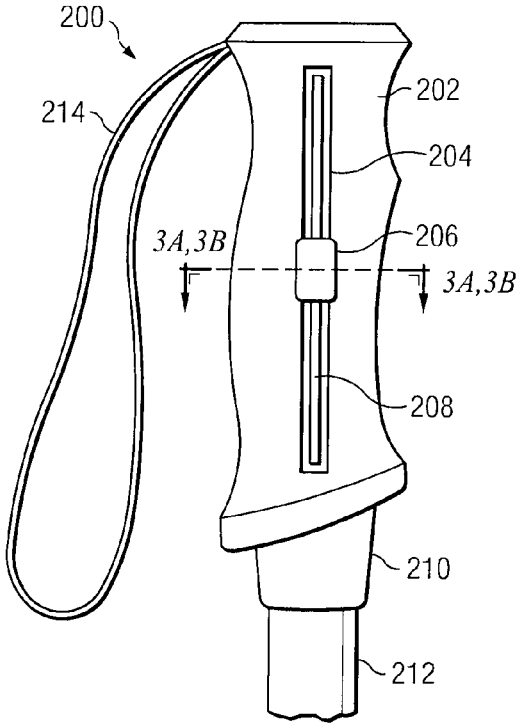
FIGS. 2A, 2B, and 2C show a ski pole/map assembly 200 according to one embodiment.
Figure 2B:
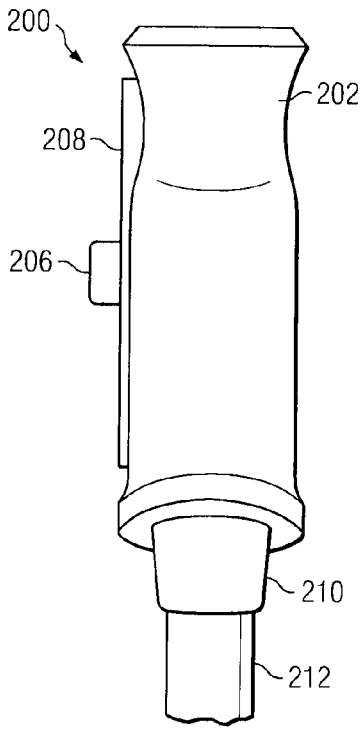
Figure 2C:
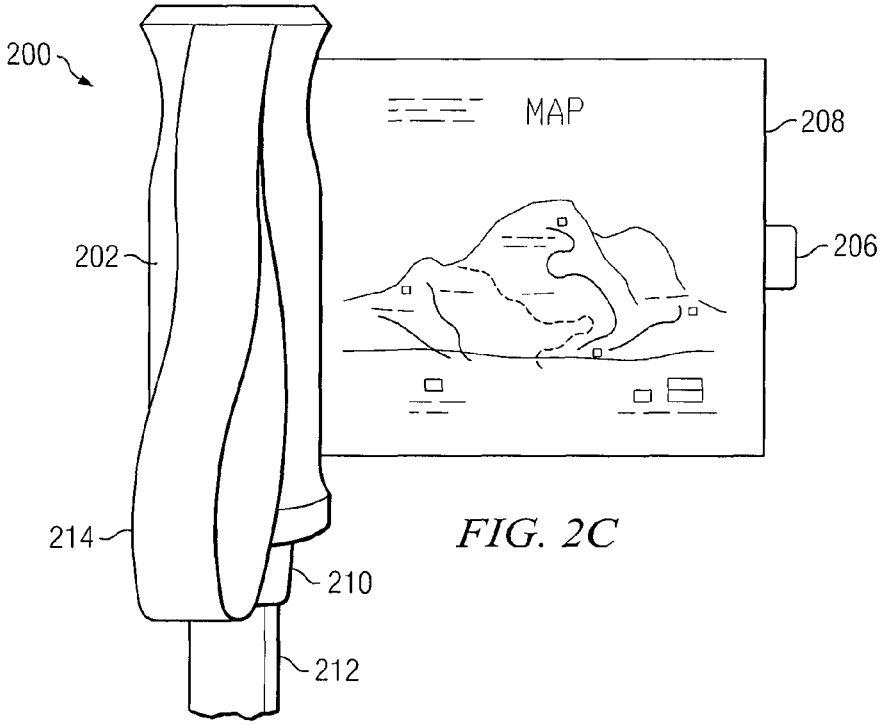

FIGS. 2A, 2B, and 2C show a ski pole/map assembly 200 according to one embodiment. The ski pole/map assembly 200 features a grip 202, a longitudinal slot 204, a pull-out tab 206 attached to a recessed map 208, a grip coupler 210, a shaft 212, and a strap 214.

FIG. 2A shows a side view of grip 202 housing recessed map 208. FIG. 2B shows a front view of grip 202 housing recessed map 208. FIG. 2C shows ski pole/map assembly 200 of FIGS. 2A and 2B with recessed map 208 in a fully extended position.

Grip 202 and shaft 212 may represent any suitable components that may be combined to form a ski pole. For example, grip 202 may include any suitable apparatus that a user may use to hold the ski pole. Grip 202 may be manufactured from any suitable material; for example, in some embodiments, grip 202 may include a plastic handle, a rubber grasp, or any other suitable component. In some embodiments, grip 202 may include indentations for a user to hold. Shaft 212 may be made of any suitable material. For example, in one embodiment, the shaft 106 may be made of a light-weight polymer or laminate.

In some embodiments, grip 202 may be configured to house recessed map 208. For example, grip 202 may incorporate a container, such as container 110 of FIG. 1C. In some embodiments, recessed map 208 may freely roll up inside of grip 202. In other embodiments, recessed map 208 may be coupled to a spring winding mechanism inside of grip 202. An example of the spring winding mechanism may include the spring winding mechanism 312 of FIGS. 3A and 3*b*.

Recessed map 208 may represent any suitable representation of the skiing area. For example, in some embodiments, recessed map 208 may pictorially represent a network of ski trails on a mountain. Recessed map 208 may be made from any suitable material. For example recessed map 208 may be made from a waterproof paper, vinyl, laminated paper, or any other suitable material. In some embodiments, the recessed map 208 may be encompassed by a weatherproof sleeve, such as the sleeve 116 of FIGS. 1A-1G.

Strap 214 may include any suitable band attached to grip 202 that allows a user to hold ski pole/map assembly 200. For example, strap 214 may be configured in a loop sized to wrap around a skier's wrist. Strap 214 may be made of any suitable material, such as nylon or rubber.

Grip coupler 210 may include any device operable to attach grip 202 to shaft 212. In some embodiments, grip coupler 210 may extend from grip 202 and be made of a similar material as grip 202. In other embodiments, grip coupler 210 may extend from shaft 212 and be made of a similar material as shaft 212.

Longitudinal slot 204 may represent any suitable opening that allows recessed map 208 to pass through the opening. Longitudinal slot 204 may be any suitable size to accommodate map 208. In some embodiments, longitudinal slot 204 is located on the right side of the grip 202 and/or on the left side of the grip 202. This allows recessed map 208 to be pulled through longitudinal slot 204 while the skier continues to hold grip 202.

Pull-out tab 206 may represent any suitable component configured to attach to recessed map 208 and to allow a user to access recessed map 208. For example, in some embodiments, pull-out tab 206 may be configured to allow a user to retrieve recessed map 208 while recessed map 208 is completely housed within grip 202; in this example embodiment, pull-out tab 206 may provide access to recessed map 208 while grip 202 protects recessed map 208 from the outside elements.

In operation, a skier may need to quickly look at a facility map without removing his gloves. For example, the skier may pull pull-out tab 206 from the side of grip 202, fully extending recessed map 208 from inside grip 202 and through longitudinal slot 204.

Figure 3A:
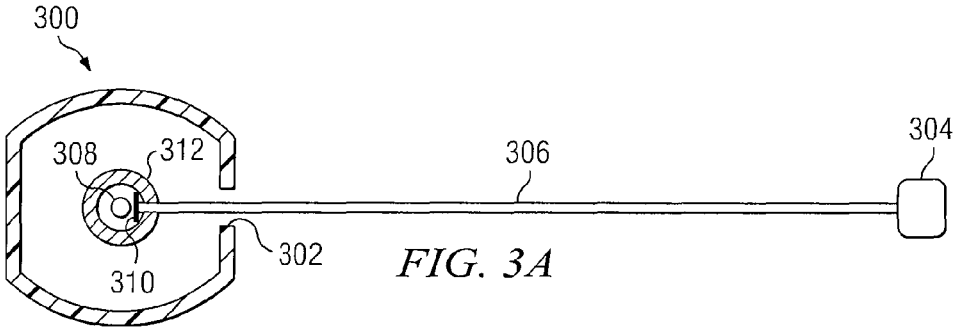
FIGS. 3A and 3B show a cross sectional top view of a map container according to one embodiment.
Figure 3B:
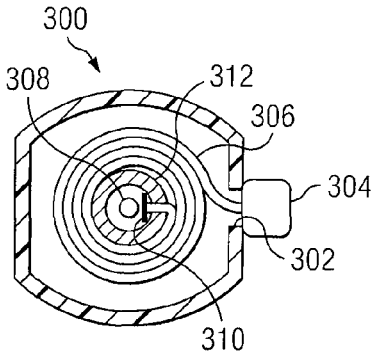

FIGS. 3A and 3B show a cross sectional top view of a map container 300 according to one embodiment. In the illustrated embodiment, map container 300 features a longitudinal slot 302, a pull-out tab 304, a recessed map 306, a map roller 308, a map tab 310, and a spring winding mechanism 312. FIG. 3A shows a cross sectional top view of map container 300 with recessed map 306 in the fully extended position. FIG. 3B shows a cross sectional top view of map container 300 with recessed map 306 in the fully retracted position.

Map container 300 may include any device operable to house map 104. One example of map container 300 may include map container 110 of FIG. 1C. In some embodiments, embodiments of map container 300 may also represent or be incorporated into grip 202 of FIGS. 2A-2C.

Recessed map 306 may represent any suitable representation of the skiing area. For example, in some embodiments, recessed map 306 may pictorially represent a network of ski trails on a mountain. Recessed map 208 may be made from any suitable material. For example recessed map 306 may be made from a waterproof paper, vinyl, laminated paper, or any other suitable material. In some embodiments, the recessed map 306 may be encompassed by a weatherproof sleeve, such as the sleeve 116 of FIGS. 1A-1G.

Longitudinal slot 302 may represent any suitable opening that allows recessed map 306 to pass through the opening. Longitudinal slot 302 may be any suitable size to accommodate map 306.

Pull-out tab 304 may represent any suitable component configured to attach to recessed map 306 and to allow a user to access recessed map 306. For example, in some embodiments, pull-out tab 304 may be configured to allow a user to retrieve recessed map 306 while recessed map 304 is completely housed within container 300; in this example embodiment, pull-out tab 304 may provide access to recessed map 306 while container 300 protects recessed map 306 from the outside elements.

Map roller 308 may include any component operable to be housed within map container 300 and facilitate movement of recessed map 306. Map tab 310 may include any component operable to attach recessed map 306 to map roller 308 and to keep recessed map 306 attached to map container 300 if pull-out tab 304 is pulled too hard. Spring winding mechanism 312 may include any component operable to facilitate extension and retraction of recessed map 306 into and out of map container 300 through longitudinal slot 302.

In operation, if the skier wants to view recessed map 306, but recessed map 306 is fully retracted in map container 300, the skier may pull pull-out tab 304. This disengages spring winding mechanism 312 and causes recessed map 306 to unwind from map roller 308.

If recessed map 306 is in the fully extended position and the skier then wants to continue skiing, the skier may again pull pull-out tab 304. This briefly engages spring winding mechanism 312, which causes spring recessed map 306 to wind around map roller 308 until recessed map 306 is fully retracted inside map container 300.

Figure 3C:
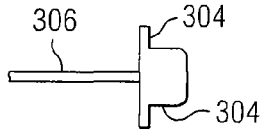
FIGS. 3C and 3D show two alternative example embodiments of the pull-out tab of FIGS. 3A and 3B.
Figure 3D:
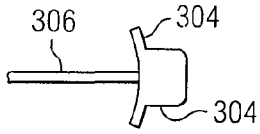

Teachings of certain embodiments recognize that pull-out tab 304 may allow the skier convenient access to recessed map 306 by prohibiting the free end of recessed map 306 from retracting completely inside map container 300. For example, FIGS. 3C and 3D show two alternative example embodiments of pull-out tab 304. In FIGS. 3C and 3D, pull-out tab 304 is larger than longitudinal slot 302, thus prohibiting the free end of recessed map 306 from retracting completely inside map container 300. In FIG. 3C, pull-out tab 304 is flat; in FIG. 3D, pull-out tab 304 is curved to match the curvature of map container 300. In both example embodiments, pull-out tab 304 also features a portion enabling the skier to grab and pull out recessed map 306.

Figure 4:
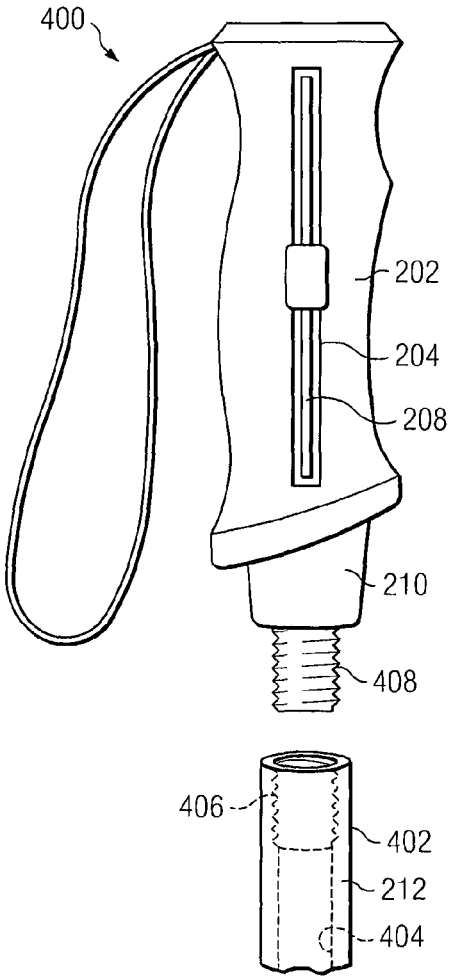
FIG. 4 shows an interchangeable map system according to one embodiment.

FIG. 4 shows an interchangeable map system 400 according to one embodiment. This example embodiment incorporates features from ski pole/map assembly 200 of FIGS. 2A-2C. Any other suitable embodiments may also incorporate an interchangeable map system 400.

Interchangeable map system 400 features grip 202, longitudinal slot 204, pull-out tab 206, recessed map 208, grip coupler 210, shaft 212, an outer shaft wall 402, an inner shaft wall 404, a female threaded shaft recipient 406, and a male threaded grip attachment 408.

In the illustrated embodiment, shaft 212 is hallow, and outer shaft wall 402 and inner shaft wall 404 represent the outer and inner surfaces of shaft 212. Female threaded shaft recipient 406 and male threaded grip attachment 408 represents one embodiment of a mechanism for attaching grip 202 and/or grip coupler 210 to shaft 212. In the illustrated embodiment, grip coupler 210 is configured with male threaded grip attachment 408 at the base of grip coupler 210, and female threaded shaft recipient 406 is located proximate the end of shaft 212 to be connected to the grip 202. In some embodiments, male threaded grip attachment 408 located at the base of grip coupler 210 may be the same diameter as inner shaft wall 404. Both female threaded grip attachment 406 and male threaded grip attachment 408 may be threaded in the same direction, allowing grip 202 to firmly screw into shaft 212.

In one embodiment, recessed map 208 attaches to map roller 302 by the map tab 304 and is extended or retracted from the grip 202 using spring winding mechanism 312 as described in FIGS. 3A and 3B.

In operation, a skier may include recessed map 208 of facility A in ski pole grip 202. The skier may switch the recessed map 208 of facility A with a recessed map 208 of facility B by replacing grips 202. For example, the skier may unscrew a first grip 202 from shaft 212 and replace the first grip 202 with a second grip 202.

Figure 5A:
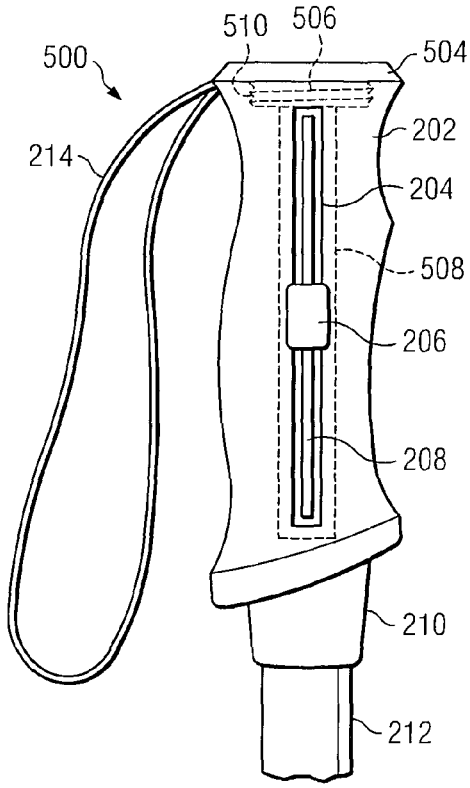
FIGS. 5A, 5B, and 5C show a screw-top grip system according to one embodiment.
Figure 5B:
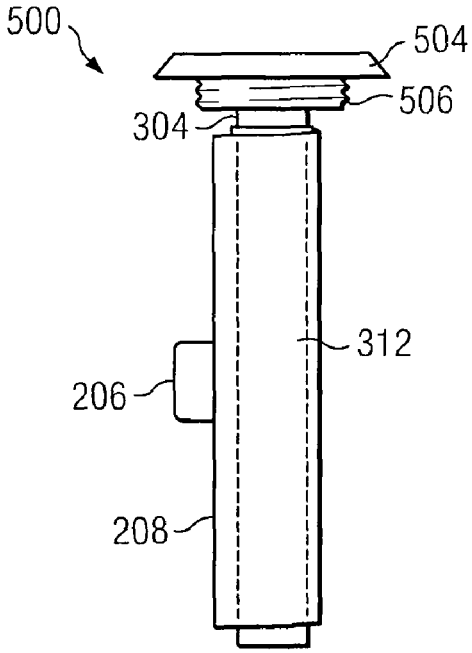
Figure 5C:
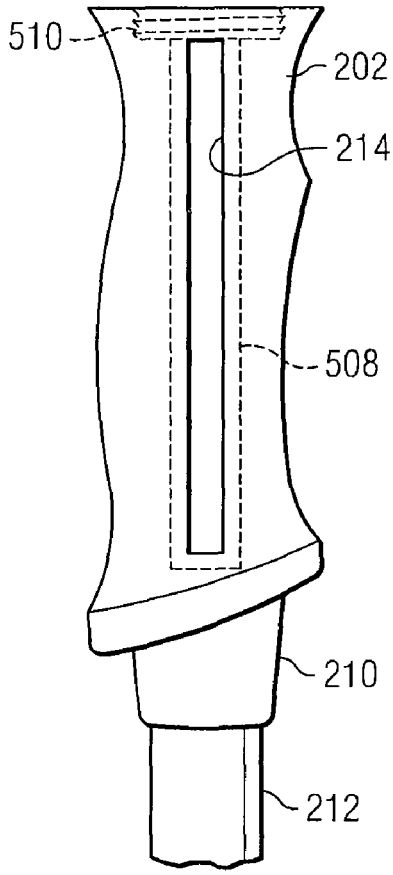

FIGS. 5A, 5B, and 5C show a screw-top grip system 500 according to one embodiment. This example embodiment incorporates features from ski pole/map assembly 200 of FIGS. 2A-2C. Any other suitable embodiment may also incorporate a screw-top system 500.

Screw-top grip system 500 features grip 202, longitudinal slot 204, pull-out tab 206, recessed map 208, grip coupler 210, map roller 304, spring winding mechanism 312, a screw-top lid 504, a male threaded screw-top attachment 506, a recessed map housing cylinder 508, and a female threaded screw-top lid recipient 510.

FIG. 5A shows screw-top grip system 500 with screw-top lid 504 screwed into grip 202. FIG. 5B shows screw-top lid 504 with recessed map 208 affixed to spring winding mechanism 312. FIG. 5C shows the grip 202 separate from the screw-top lid 504.

Screw-top lid 504 may include any suitable component operable to secure to the top of grip 202. In some embodiments, map roller 304 may be attached to screw-top lid 504, and recessed map 208 may be wrapped around map roller 304. When screw-top lid 504 is secured to grip 202, map roller 304 and recessed map 208 may fit inside recessed map housing cylinder 508. Recessed map housing cylinder 508 may include any opening in grip 202 suitable for receiving map roller 304 and recessed map 208.

In some embodiments, screw-top lid 504 may be configured with male threaded screw-top lid attachment 506, and grip 202 may be configured with female-threaded screw-top lid recipient 510. Male threaded screw-top lid attachment 506 and female-threaded screw-top lid recipient 510 may include any components operable to secure screw-top lid 504 to grip 202.

In some embodiments, recessed map 208 may be attached to spring winding mechanism 312 and rolled around map roller 304 as described in FIGS. 3A and 3B.

Figure 6A:
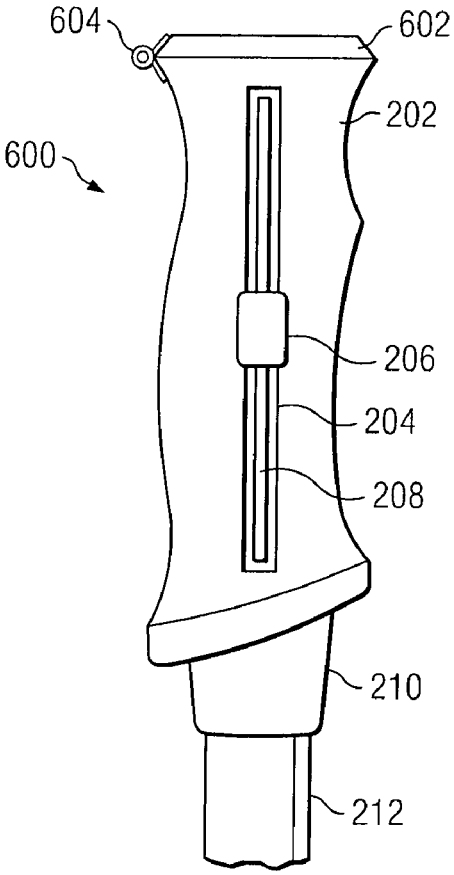
FIGS. 6A and 6B show a pop-top grip system according to one embodiment.
Figure 6B:
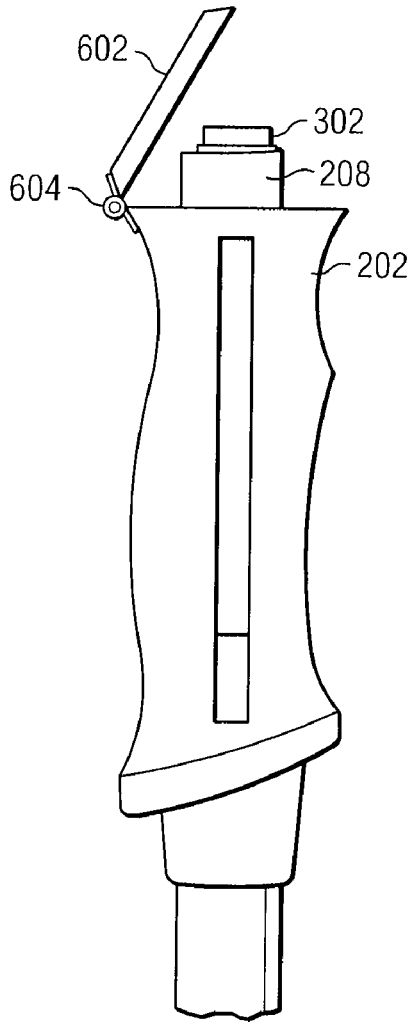

FIGS. 6A and 6B show a pop-top grip system 600 according to one embodiment. This example embodiment incorporates features from the ski pole/map assembly 200 of FIGS. 2A-2C. Any other suitable embodiment may also incorporate an pop-top system 600.

Pop-top grip system 600 features grip 202, longitudinal slot 204, pull-out tab 206, recessed map 208, grip coupler 210, map roller 304, spring winding mechanism 312, a pop-top lid 602, and a hinge 604. FIG. 6A shows the pop-top grip system 600 with the pop-top lid 602 in the closed position. FIG. 6B shows the pop-top grip system 600 with the pop-top lid 602 in the open position.

Hinge 604 may include any suitable device operable to secure pop-top lid 602 against grip 202. For example, in some embodiments, grip 202 may be permanently affixed to shaft 212 at grip coupler 210. In this embodiment, pop-top lid 602 is located opposite grip coupler 210.

In some embodiments, recessed map 208 may extend from and retracted into grip 202 using map roller 304 and spring winding mechanism 312, as described with regard to FIGS. 3A and 3B.

FIGS. 7A, 7B, 7C, 7D, 7E, and 7F show an electronic map system 700 according to several embodiments. Electronic map system 700 features a display 702, user interface buttons 704, and a housing 706 attached to a ski pole 708.

Figure 7A:
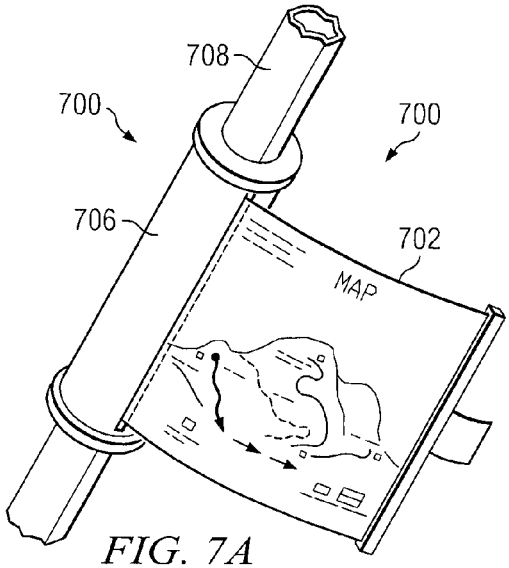
FIGS. 7A, 7B, 7C, 7D, 7E, and 7F show an electronic map system according to several embodiments.
Figure 7B:
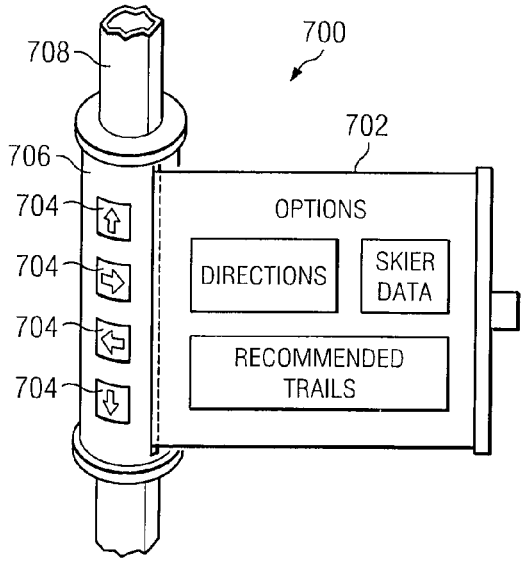

Embodiments of display 702 may include any suitable display operable to present information to a user. For example, FIGS. 7A and 7B show a flexible electronic display 702. In one embodiment, flexible electronic display 702 may be a flexible substrate material suitable to display the map image. One example of a flexible substrate material may include a plurality of organic light emitting diodes (OLED). Teachings of certain embodiments recognize that flexible electronic display 702 may be coupled to a spring-winding mechanism within housing 706, and may be configured to roll up around the spring-winding mechanism. An example of the spring winding mechanism may include the spring winding mechanism 312 of FIGS. 3A and 3*b*.

Figure 7C:
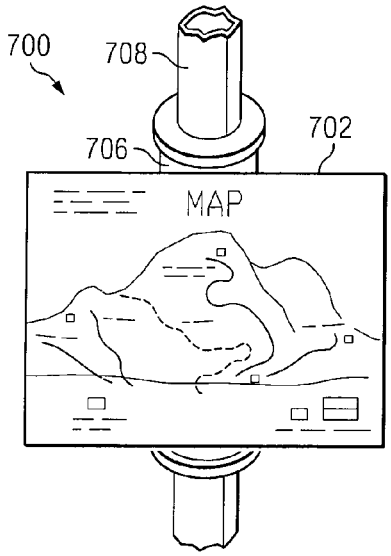
Figure 7D:
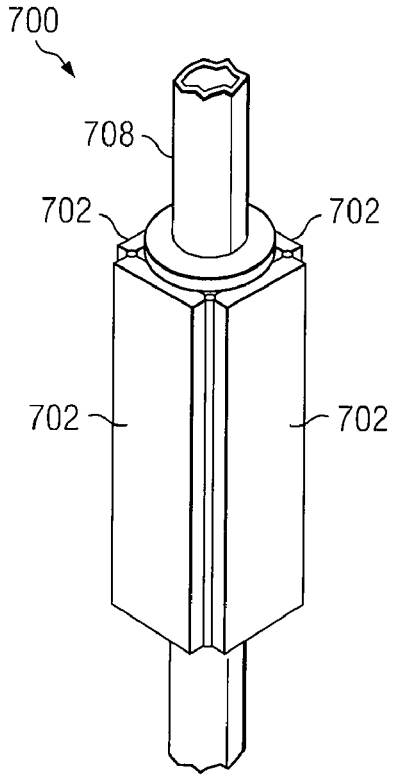
Figure 7E:
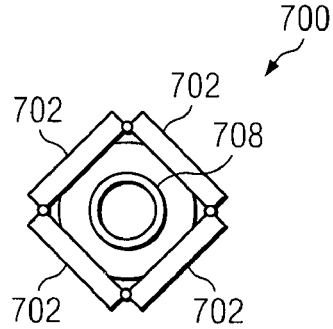

In another example, FIG. 7C shows a rigid electronic display 702 directly attached to housing 706. In yet another example, FIGS. 7D and 7E show an embodiment of rigid electronic display 702 that includes a plurality of smaller displays. These smaller displays may be configured in such a way that they fold up in order to reduce the overall size of electronic display 702 while it is not in use.

Housing 706 may include any suitable structure for housing one or more electronic components of system 700, such as a processor, memory, and/or communications link. Examples of the processor, memory, and communications link may include processor 12, memory 14, and communications link 24, as shown in FIG. 7F.

Figure 7F:
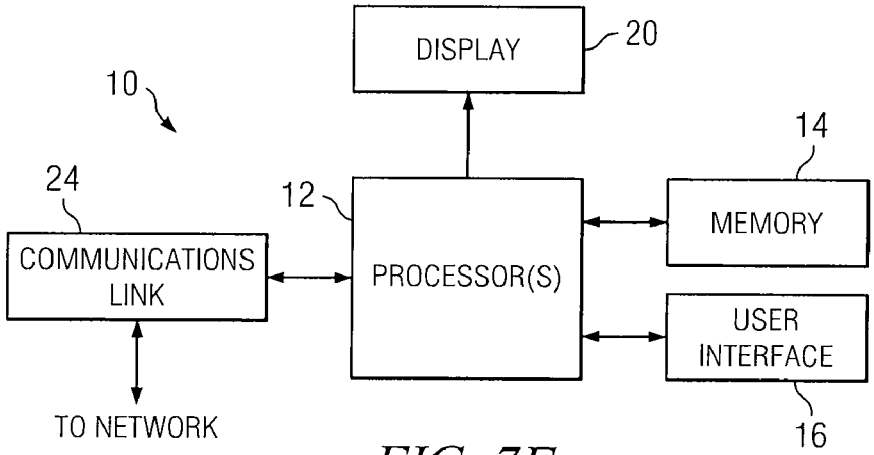

FIG. 7F presents a block diagram of one or more components of electronic map system 700 according to one embodiment. Electronic map system 700 in this embodiment comprises processor 12, memory 14, user interface 16, display 20, and communications link 24. In other embodiments, the electronic map system 700 may include more, less, or other component parts. Electronic map system 700 may generally be adapted to execute any of the well-known OS2, UNIX, MacOS, Linux, and Windows Operating Systems or other operating systems.

Several embodiments may include logic contained within a medium. Logic may include hardware, software, and/or other logic. Logic may be encoded in one or more tangible media and may perform operations when executed by a computer. Certain logic, such as processor 12, may manage the operation of electronic map system 700. Examples of processor 12 include one or more microprocessors, one or more applications, and/or other logic. Certain logic may include a computer program, software, computer executable instructions, and/or instructions capable being executed by electronic map system 700. In particular embodiments, operations of embodiments may be performed by one or more computer readable media storing, embodied with, and/or encoded with a computer program and/or having a stored and/or an encoded computer program. The logic may also be embedded within any other suitable medium without departing from the scope of the invention.

Logic may be stored on a medium such as memory 14. Memory 14 may comprise one or more tangible computer-readable and/or computer-executable storage medium. Examples of memory 14 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

The communications link 24 may be connected to a computer network or a variety of other communicative platforms including, but not limited to, a public or private data network; a local area network (LAN); a metropolitan area network (MAN); a wide area network (WAN); a wireline or wireless network; a local, regional, or global communication network; an optical network; a satellite network; an enterprise intranet; other suitable communication links; or any combination of the preceding.

For example, in one embodiment, the communications link 24 may be connected to a global positioning network. In one embodiment, electronic system 700 includes a global positioning system (GPS) including an antenna for receiving the user's current location from satellites. The GPS antenna may be housed in any suitable location including, but not limited to, inside housing 706 or inside ski pole 708. Electronic system 700 may be configured in such a way to display various data including, but not limited to, the current location of the user, the user's relative position on the map, the distance between the user's current position and another trail, and visual directions to another trail.

In one embodiment, electronic system 700 may be configured to receive software or firmware updates. Such updates may include, but are not limited to map updates, GPS software updates, or electronic display firmware updates. Certain embodiments of the communications link 24 may include an electronic port configured to receive such updates. The electronic port may be any suitable interface, including USB, RJ45, or IEEE 1394. Other embodiments may include an antenna that is operable to receive such updates through any suitable wireless network such as, but not limited to, mobile phone networks, satellite connections, or wireless LAN networks.

In one embodiment, electronic system 700 includes logic and components configured to collect various skier data including, but not limited to, real time and average skier speed and overall time elapsed while skiing.

In some embodiments, the electronic system 700 includes user interface 16. The user interface 16 may be configured in certain embodiments to receive input from the user. For example, user interface 16 may prompt a user to choose certain data to display including, but not limited to, directions to another trail, recommended trails at the current ski area, and skier data.

In some embodiments, user interface 16 may include user interface buttons 704. User interface buttons 704 may include any components configured to receive user input from a skier. In some embodiments, user interface buttons 704 may be sized such that a skier can select user interface buttons 704 while wearing ski gloves.

Although the illustrated embodiment provides one embodiment of a computer that may be used with other embodiments of the invention, such other embodiments may additionally utilize computers other than general purpose computers as well as general purpose computers without conventional operating systems. Additionally, embodiments of the invention may also employ multiple electronic map systems 700 or other computers networked together in a computer network. For example, multiple electronic map systems 700 or other computers may be networked through the Internet and/or in a client server network. Embodiments of the invention may also be used with a combination of separate computer networks each linked together by a private or a public network.

Modifications, additions, or omissions may be made to the systems and apparatuses described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

To aid the Patent Office, and any readers of any patent issued on this application in interpreting the claims appended hereto, applicants wish to note that they do not intend any of the appended claims to invoke 6 of 35 U.S.C. §112 as it exists on the date of filing hereof unless the words "means for" or "step for" are explicitly used in the particular claim.

What is claimed is:

1. An apparatus comprising:

a ski pole comprising a first pole end, a second pole end opposite the first pole end, and a shaft connecting the first and second pole ends; and a first map coupled to the ski pole, the first map comprising a first map end and a second map end opposite the first map end, wherein the first map is coupled to the ski pole at the first map end, wherein the first map is printed on a weatherproof material;

a second map coupled to the ski pole, the second map comprising a third map end and a fourth map end opposite the third map end, wherein the second map is coupled to the ski pole at the third map end, wherein the second map is printed on a weatherproof material;

a first tab attached to the second map end, the first tab comprising a connecting material operable to secure the second map end to a corresponding connection material on the ski pole when the first map is wrapped around the outside of the ski pole;

a second tab attached to the fourth map end, the second tab comprising a connecting material operable to secure the fourth map end to the corresponding connection material on the ski pole when the second map is wrapped around the outside of the ski pole.

2. The apparatus of claim 1, further comprising a weatherproof sleeve operable to encompass the map, the weatherproof sleeve comprising a sealable opening configured to facilitate removal of the map from the weatherproof sleeve and insertion of a second map into the weatherproof sleeve.

3. The apparatus of claim 1, further comprising a fastening attachment coupled to the second map end, the fastening attachment operable to releasably couple to a second shaft of a second ski pole.

* * * * *